US005784808A

United States Patent [19]

Hockerson

[11] Patent Number: 5,784,808

[45] **Date of Patent: *Jul. 28, 1998**

[54] INDEPENDENT IMPACT SUSPENSION ATHLETIC SHOE

[76] Inventor: Stan Hockerson, 1716 Gerogia St., NE., Albuquerque, N. Mex. 87110

[ * ] Notice: This patent issued on a continued prosecution application filed under 37 CFR 1.53(d), and is subject to the twenty year patent term provisions of 35 U.S.C. 154(a)(2).

[21] Appl. No.: 714,964

[22] Filed: Sep. 17, 1996

Related U.S. Application Data

[63] Continuation of Ser. No. 400,336, Mar. 8, 1995, abandoned, which is a continuation-in-part of Ser. No. 259,744, Jun. 14, 1994, abandoned, which is a continuation of Ser. No. 24,601, Mar. 1, 1993, abandoned.

[51] Int. Cl.[6] ..... A43B 13/18

[52] U.S. Cl. ..... 36/102; 36/30 R; 36/28

[58] Field of Search ..... 36/114, 59 C, 36/30 R, 102, 103, 28

[56] References Cited

U.S. PATENT DOCUMENTS

| | | | |
|---|---|---|---|
| 2,155,166 | 4/1939 | Kraft . | |
| 3,100,354 | 8/1963 | Lombard . | |
| 3,629,962 | 12/1971 | Brock . | |
| 4,083,125 | 4/1978 | Benseler . | |
| 4,305,212 | 12/1981 | Coomer . | |
| 4,309,832 | 1/1982 | Hunt . | |
| 4,322,895 | 4/1982 | Hockerson . | |
| 4,439,936 | 4/1984 | Clarke et al. . | |
| 4,694,591 | 9/1987 | Banich . | |
| 4,939,851 | 7/1990 | Miller | 36/3 B |

FOREIGN PATENT DOCUMENTS

| | | |
|---|---|---|
| 218631 | 12/1941 | Switzerland . |
| 9105491 | 2/1991 | WIPO . |
| 9111924 | 8/1991 | WIPO . |

*Primary Examiner*—Ted Kavanaugh

*Attorney, Agent, or Firm*—Flehr Hohbach Test Albritton & Herbert LLP

[57] ABSTRACT

An athletic shoe comprising an upper mounted on a sole which is formed with a longitudinal channel that separates the sole into a pair of laterally adjacent compression elements which can move independent of each other. A rigid heel counter is provided in the upper above the heel portion. As the shoe pronates from the heel strike phase to the loading phase the compression element on the lateral side compresses to begin absorbing shock and moves independent of the medial compression element. At the same time the heel counter supports the foot so that the foot undergoes a more natural movement throughout the heel strike, loading and pronation phases.

3 Claims, 3 Drawing Sheets

INDEPENDENT IMPACT SUSPENSION ATHLETIC SHOE

CROSS-REFERENCE TO RELATED APPLICATIONS

This is a continuation of application Ser. No. 08/400,336 filed Mar. 8, 1995 now abandoned, which is a continuation-in-part of application Ser. No. 08/259,744 filed Jun. 14, 1994 now abandoned, which is a continuation of application Ser. No. 08/024,601 filed Mar. 1,1993 now abandoned.

BACKGROUND OF THE INVENTION

1. Field of the Invention

This invention relates in general to athletic shoes, and in particular relates to athletic shoes for sports such as running, jogging and cross-training.

More particularly, the invention relates to athletic shoes having midsole portions which provide independent shock absorption of corresponding forces and concomitant gait control.

2. Description of the Related Art

Recent developments in the design of athletic shoes have led to relatively lightweight shoes with soles formed of materials selected for optimum cushioning and flexibility and with minimal sole wear. Despite these improvements in shoe design, many individuals continue to develop injuries which can be traced to foot problems and shortcomings in the design of the shoes they are wearing. Among these problems are Achilles tendonitis caused by physiological defects such as short Achilles and problems such as an unstable heel, inverted heel, weak arch and excessive use of toe flexers; metatarsal stress fracture caused by an unstable heel, pronatory abnormalities and forefoot problems; and runner's knee (chondromalacia) caused by conditions such as weak foot, forefoot varus, Morton's foot and pronatory foot influences including an unstable heel.

Among the solutions which have been employed to correct the foregoing problems are the use of orthotics that are prescribed for particular individuals. The orthotics are fitted within the heel cup of a shoe to control pronation throughout heel and forefoot contacts during the gait cycle. Certain shoes have been designed which incorporate a varus wedge which operate in a similar manner to orthotics for control of foot pronation. Other designs incorporate a flared sole construction resulting in a pyramid shaped midsole which has the objective of providing more stability for the shoe during rear foot impact.

Various attempts have been made to prevent overpronation or oversupination of the wearer's foot as the shoe strikes the ground. These include stiffening the heel counter, and upward extension of the midsole area to encompass at least a portion of the upper. In addition, new materials have been incorporated into shoe designs to increase strength.

All prior ideas and shoe designs have been attempts to stabilize the foot by increasing the structural strength of shoe. None of the prior shoe designs have controlled the wear on the shoe while simultaneously allowing for differences in the individual gaits and concomitant forces placed on the shoe by the individual's foot.

Despite various conventional improvements in shoe design, injuries continue to occur due to the fundamental flaw of not providing a mass produced shoe which can adjust to the needs of each individual wearer. The most frequently recurring problems are due to instability in the wearer's heel, arch and toe areas due to the inability of the shoe to adjust to the particular wearer's gait and corresponding varying forces. These features also tend to interfere with the natural gait of the wearer, e.g. by raising the level of the wearer's heel, or by accelerating pronation of the individual's foot during normal walking or running activity.

FIG. 1 illustrates a prior art conventional shoe 10 comprising an upper 12 and sole 18. During the initial heel strike phase of the running cycle the shoe is in the normal supinated position, as illustrated in FIG. 1, when viewed from behind for the right shoe of an individual. The maximum shock forces are absorbed by the sole and heel portions during the initial phase of heel strike. These forces, in conventional shoes, compress the outer rim of the sole at 16, which also tends to collapse or flex the upper heel wrap at 17 creating correlative forces shown by the arrows at 20 on the upper, at 22 on the heel wrap and at 24 on the sole. The correlative forces create abnormal shock absorption and stress on the sides of the shoe and the runner's foot. The corresponding result is an abnormal transfer of force upon the runner's foot during normal walking or running. This results in decreased stability and control for the runner's heel.

The feet of most runners strike the surface in a supinated position and tend to pronate, i.e. rotate toward the medial side, as they continue through the running cycle. Conventional shoes of the type shown in FIG. 1 do not provide adequate support for this type of motion. Certain prior art shoe designs have attempted to alleviate the foregoing problem by incorporating various grooves and channels within the outsole of the shoe. However, these grooves or channels are not sufficiently deep to permit the sole to independently react to shock absorption relative to the left lateral and right lateral portions of the sole and upper. The conventionally designed grooves, as shown in 23 of FIG. 1, do not allow the left and right lateral halves of the sole to independently react to the runner's foot when corresponding forces are placed on the runner's foot upon impact.

OBJECTS AND SUMMARY OF THE INVENTION

It is an object of the present invention to provide an athletic shoe which obviates the problems that arise from overpronation and oversupination.

It is another object to provide an athletic shoe which combines a rigid heel counter with a sole that is divided by a channel into lateral and medial compression elements so that there is independent absorption of shock forces between the lateral and medial portions of the runner's foot.

Another object of the present invention is to provide an athletic shoe which combines a rigid heel counter with a sole which is divided by a channel into lateral and medial compression elements. The compression elements independently react in relation to the runner's foot and keep the heel in proper alignment such that the body is in a more natural position to absorb shock.

The present invention in summary provides an athletic shoe having an upper with a rigid heel counter in combination with a sole which is divided into medial and lateral independent compression elements. The compression elements are separated by a deep channel which is spaced apart sufficiently to isolate the elements so that pronation movement of the shoe throughout the heel strike and loading phases is with low acceleration.

The foregoing and additional objects and features of the invention will appear from the following specification in which the embodiments have been set forth in detail in conjunction with the accompanying drawings.

DESCRIPTION OF THE PREFERRED EMBODIMENTS

Figure 1:
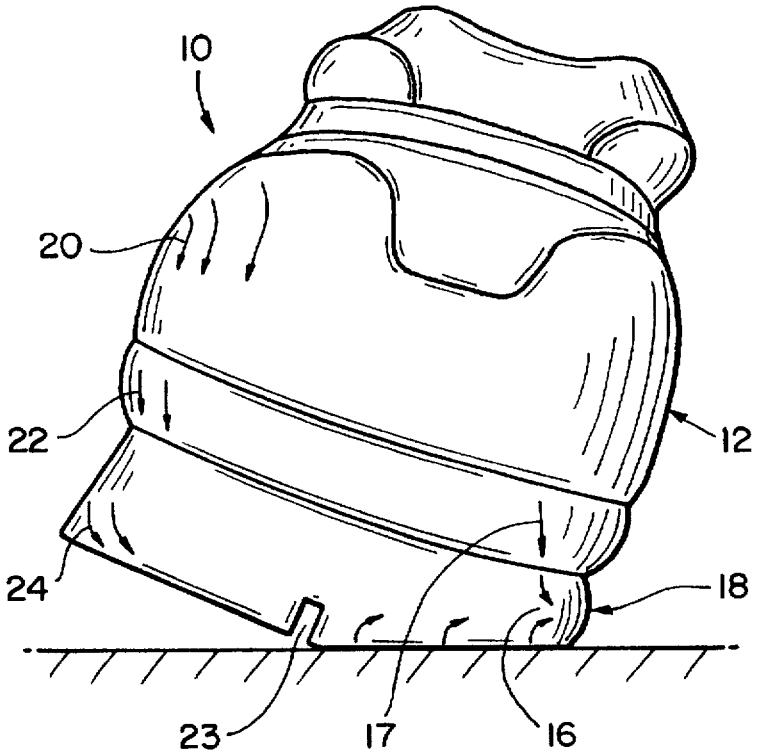
FIG 1 (PRIOR ART)
FIG. 1 is a rear elevational view of a prior art athletic shoe shown in a supinated position following initial heel contact with a surface.
Figure 2:
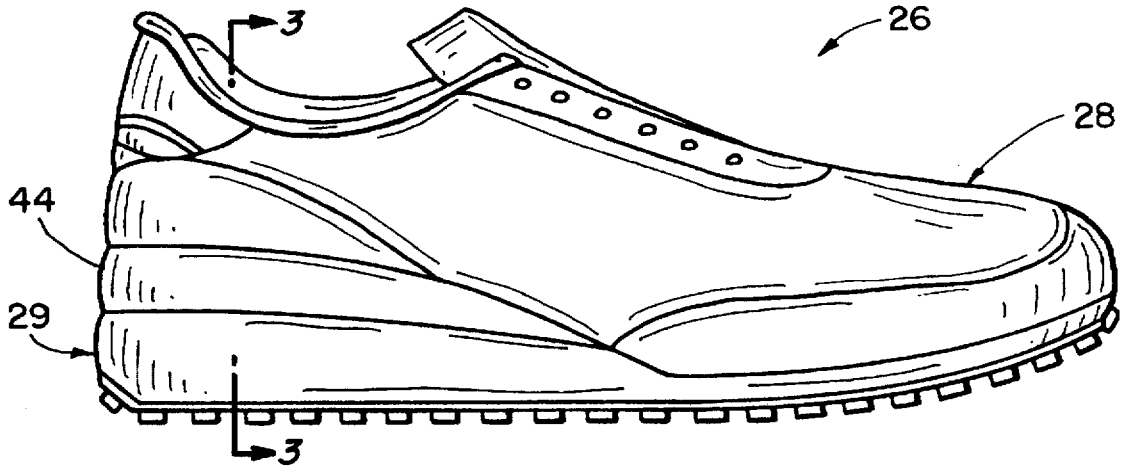
FIG. 2 is a side elevational view of an athletic shoe incorporating one embodiment of the invention.

FIG. 1 illustrates generally at 10 a prior art athletic shoe having an upper 12 mounted to a sole 18. The sole 18 is formed with a shallow longitudinal channel 23. The purpose of the channel 23 and sole 18 is to provide better traction and stability for the runner during normal and stressed gaits. FIG. 1 depicts the rear view of the right shoe worn by an individual at the heel strike phase when the foot is in a supinated position. The full gait cycle is from the heel strike phase to a loading phase at which the sole is flat on the surface, then to a pronation phase at which the shoe continues to rotate to the medial side, then to a forefoot phase, and then to a toe off phase.

At the time of initial heel contact in the supinated position, the lateral edge of the sole 18 is compressed at 16 and 17. This occurs as the impact force begins to be absorbed by the sole and is carried out through the shoe to the foot. The weight of the individual pressing down along the line above the point of impact creates a pressure which tends to collapse the upper at 20. Correlative forces 22 and 24 are thus exerted inward and downward forcing the medial portion of the right shoe to absorb a portion of the shock exerted on the lateral portions. This creates an unnatural absorption of shock on the runner's foot between the medial and lateral sides of the shoe and imparts an unnatural transfer of forces within the shoe. Similar conditions and results occur on the runner's left shoe (not shown) when it strikes a surface.

In the drawings FIGS. 2–5 illustrate generally at 26 an athletic shoe incorporating one preferred embodiment of the present invention. The shoe 26 is adapted for wearing on the user's right foot and comprises an upper 28 joined to a sole 29. The sole comprises a midsole 30 which is joined to an outsole 32. The midsole and outsole are formed of suitable synthetic polymer materials having properties of durability, flexibility and resiliency for cushioning the foot during the running cycle.

Upper 28 is slip lasted and comprises an outer lining 34, which can be of a suitable material such as leather or synthetic leather, an inner lining 36, which can be of a thin foam material of substantially 3 mm thickness, a foam insole 38 and a lasting board 40 which can be of a suitable stiff material having limited flexibility. The outer and inner linings, insole and lasting board extend substantially the entire length of the shoe. The heel portion of the shoe includes a rigid heel counter 42 for supporting and stabilizing the wearer's heel within the shoe. On the opposite medial and lateral sides of the shoe the heel counter is layered between outer liner 34 and inner liner 36.

Figure 3:
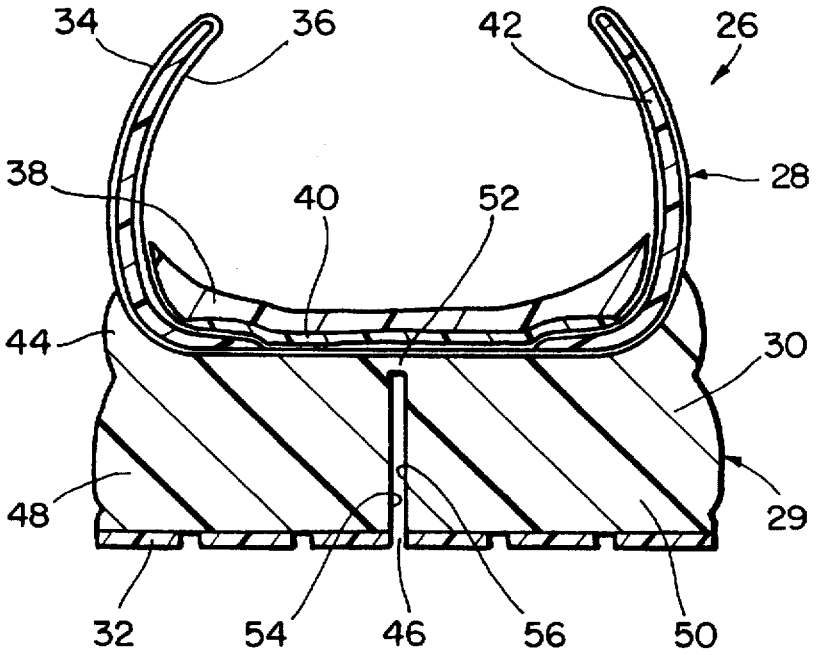
FIG. 3 is a cross sectional view taken along the line 3—3 of FIG. 2.

A midsole wrap or support band 44 is provided for resisting flexing of the sides of the heel cup relative to the midsole. The support band extends around the sole's outer periphery at the juncture between the upper and midsole, and can either be formed integrally with the midsole as shown in FIG. 3 or it can be a separate piece secured as by fusion to the midsole during manufacture. The support band functions in the manner explained in U.S. Pat. No. 4,322,895 for Stabilized Athletic Shoe issued Apr. 6, 1982 to Stan Hockerson, the inventor of the present invention.

Figure 4:
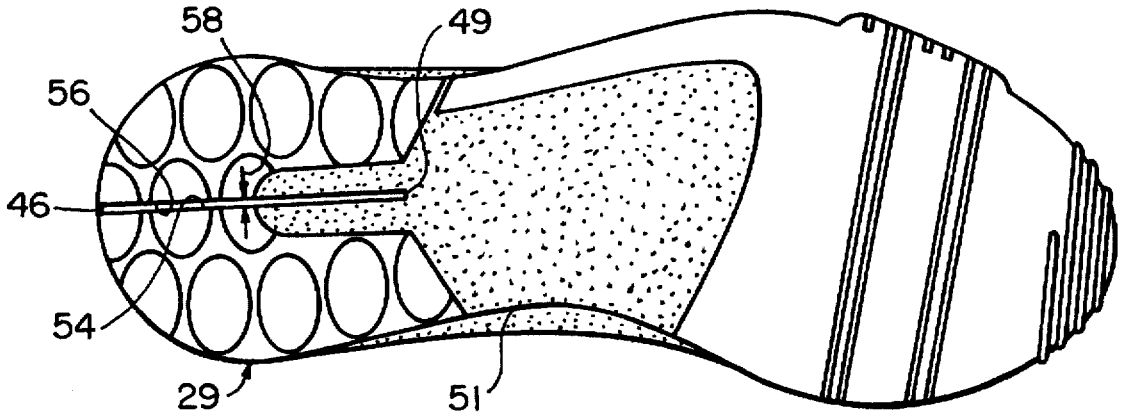
FIG. 4 is a bottom plan view of the shoe of FIG. 2.
Figure 5:
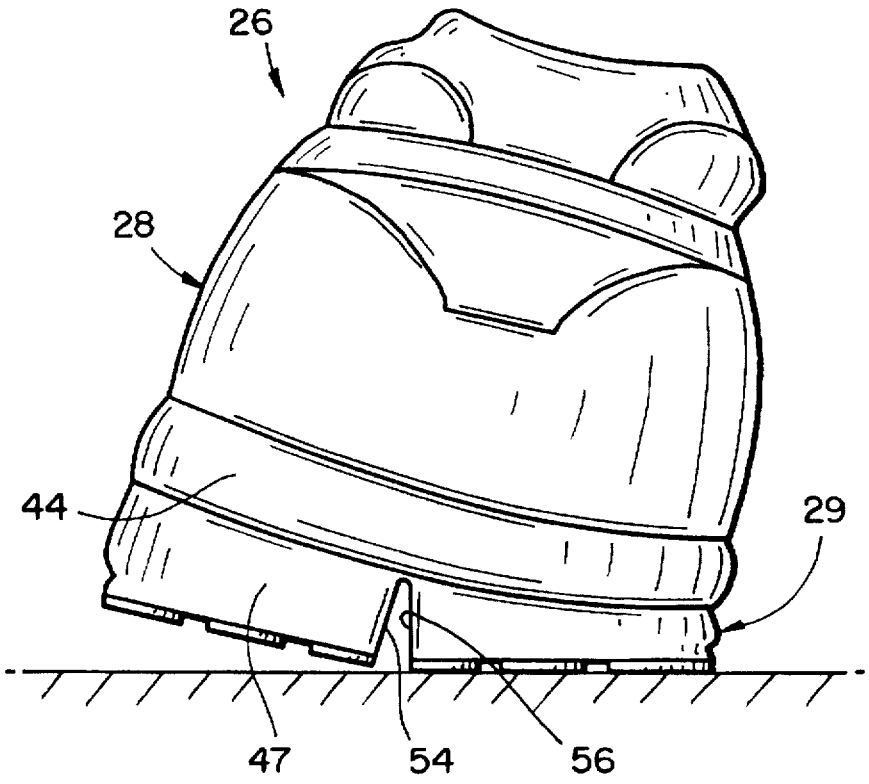
FIG. 5 is a rear elevational view of the present invention shown at a position just following initial heel contact with a surface.

A longitudinally extending, upright channel 46 is formed through the midsole and outsole. The channel penetrates rearwardly through the peripheral rim 47 of the heel portion which is thereby divided into a pair of laterally adjacent compression elements 48 and 50. Channel 46 extends forwardly to a point 48 near the instep region 50 of the sole, as illustrated in FIG. 4. The upper edge of the channel extends to a point closely adjacent the lower portion of upper 28. This leaves only a thin connecting portion 52 which is sufficiently weak to allow substantially independent movement between the two compression elements. The interior sidewalls 54, 56 of the compression elements are spaced apart by a distance 58 (FIG. 4) which is sufficiently wide to isolate the compression elements from the motion of their interior sidewalls during heel strike of the sole onto a surface. This permits independent movement or reaction of the compression elements relative to each other. The width 58 is in the range of 1 mm to 10 mm, and preferably 3 mm. The channel 46 extends longitudinally only through the heel portion of the shoe to allow for independent absorption of forces upon the compression elements as the shoe begins to pronate, i.e. rotate toward the medial side, from the supinated position following initial heel contact as shown in FIG. 5.

It is an important feature of the present invention that the longitudinal channel 46 and compression elements 48 and 50 are in combination with the rigid heel counter 42 in the shoe's upper. Athletic shoes in the prior that are formed with sipes or slots in the soles, such as described in PCT patent publication no. WO 91/05491 dated May 2, 1991 to Ellis, do not include either rigid heel counters or rigid motion control devices. In the type of shoe exemplified by the Ellis patent a rigid heel counter or motion control device would significantly reduce flexibility in the frontal plane, which is an important aspect to shoes of that type. In the present invention the combination of the longitudinal channel, independent compression elements and rigid heel counter results in natural heel strike followed by control of the foot throughout the pronation and forefoot phases of motion.

The use and operation of the invention will be explained in relation to the runner's right shoe, and it is understood that a left shoe, which would be a mirror image of the illustrated shoe 26, would operate in a similar manner. For a typical runner, the runner's foot and shoe are in a supinated position at the time of heel strike such that the lateral edge of compression element 50 makes initial ground. Compression element 50 is then compressed to a greater extent along its lateral side, permitting the underlying portion of outsole 32 to smoothly move into flat contact with the ground as pronation begins. Because channel 46 extends up substantially the entire thickness of the midsole, the change in shape and movement of lateral compression element 50 is independent of that of compression element 48. This permits the runner's foot to make a more natural heel strike during the loading phase. As pronation movement continues the lateral edge of medial compression element 48 makes ground contact to segue into the loading phase, causing this element to also compress and move relative to the shoe into a shape permitting the underlying portion of outsole 32 to smoothly move into flat contact with the ground. The pronation phase then begins, afterwhich movement of the runner causes the weight to shift forward, moving the shoe into the forefoot phase followed by the toe off phase. Throughout the heel strike, loading and pronation phases the rigid heel counter 42 in combination with the action of the compression elements maintains substantially natural heel motion.

The invention obviates the problem in conventional running shoes of the acceleration of motion that occurs during pronation motion from the lateral to the medial side. The acceleration of pronation motion occurs in connection with conventional athletic shoes because the lateral and medial portions of the midsole and outsole at the heel are connected. Thus, compression motion on the lateral side causes the medial side to react and move.

Figure 6:
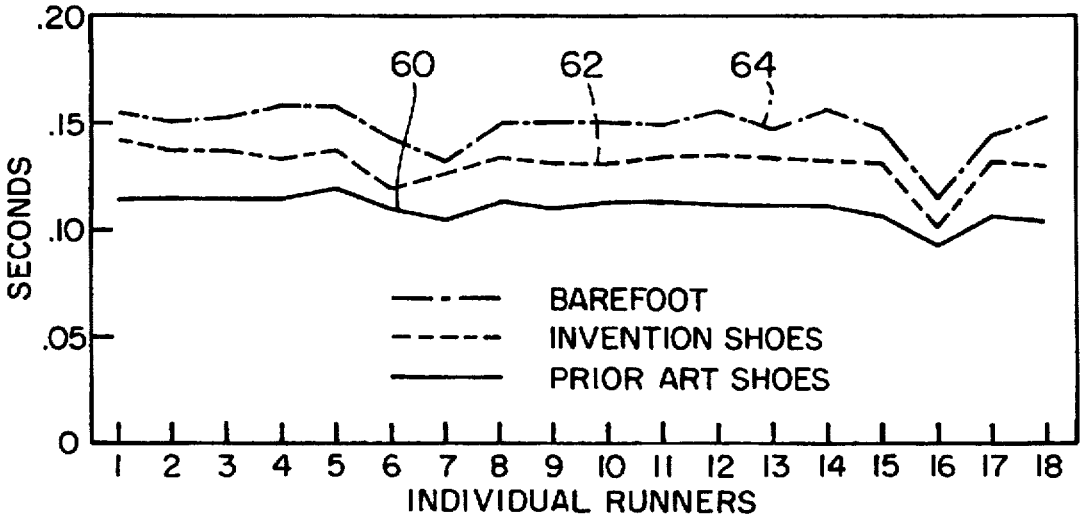
FIG. 6 is a chart depicting the results of a heel strike motion study analysis for shoes of the present invention in relation to barefoot runners and to those wearing conventional athletic shoes.

The chart of FIG. 6 graphically shows the results of a motion study analysis which compared shoes of the present invention with conventional athletic shoes and barefoot running by measuring the differences in elapsed time from heel strike to the loading phase for different runners. The analysis was conducted using a machine adapted to measure the motion of points on the lateral and medial sides of the shoes, or of the runner's foot in the case of the barefoot tests. The abscissa of the chart ranks the individual runners, who were of different heights and weights. Three tests were conducted for each of the runners, one test with the runners wearing a pair of shoes according to the present invention, another test wearing a pair of conventional shoes, and another test running barefoot. The ordinant of the chart plots the time in seconds from heel strike to the loading phase. The line 60 plots the time for the prior art conventional shoes, the line 62 plots the time for the shoes incorporating the present invention, and the line 64 plots the time for barefoot runners. The results show that the shoes incorporating the present invention, because the time from heel strike to the loading phase is longer, accelerate less than that of the conventional shoes worn by the runners. The chart of FIG. 6 also shows that the shoes of the present invention come closer to the natural barefoot gait, which is the desirable condition.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. An athletic shoe comprising an upper for wearing about a user's foot, a sole mounted to the upper, said sole having a forefoot portion and a heel portion, said heel portion comprising a midsole carried below the upper and an outsole carried below the midsole, said outsole having a bottom surface at least partially bounded by a peripheral rim, a lasting board mounted within the upper above the sole and extending forwardly from the heel portion toward the forefoot portion, said lasting board above the heel portion being devoid of penetrating channels, a rigid heel counter mounted in the upper above said heel portion, said sole being formed with a longitudinal channel in the midsole and outsole with the channel extending through the peripheral rim and with the channel dividing the midsole and outsole of the heel portion into a pair of laterally adjacent compression elements, said compression elements having interior sidewalls which are spaced apart an effective distance to isolate the compression elements from motion of their interior sidewalls and permitting independent movement of the compression elements, said channel extending upwardly through the sole and being separated from the upper by a connecting portion of the sole which has a vertical height that is effective to present a minimal transfer of motion between the compression elements responsive to stress forces whereby the heel counter and compression elements control the user's foot pronation movement with substantially low acceleration from an initial heel strike phase to a loading phase of the gait cycle for the shoe.

2. An athletic shoe as in claim 1 in which said longitudinal channel extends through only the heel portion of the sole.

3. An athletic shoe as in claim 1 in which the shoe has lateral and medial sides, and said channel extends in a plane which is positioned substantially midway between said lateral and medial sides.

* * * * *